US008776627B2

(12) United States Patent
Heffner

(10) Patent No.: US 8,776,627 B2
(45) Date of Patent: Jul. 15, 2014

(54) RECIPROCATING PUMP DRIVE ASSEMBLY

(75) Inventor: Robert Nickalos Heffner, Sandy Beach (CA)

(73) Assignee: Amik Oilfield Equipment and Rentals Ltd., Lloydminster, Alberta (CA)

( * ) Notice: Subject to any disclaimer, the term of this patent is extended or adjusted under 35 U.S.C. 154(b) by 310 days.

(21) Appl. No.: 13/462,308

(22) Filed: May 2, 2012

(65) Prior Publication Data

US 2013/0291668 A1 Nov. 7, 2013

(51) Int. Cl.
*F16H 27/02* (2006.01)

(52) U.S. Cl.
USPC ..... 74/89.22; 60/369; 175/52

(58) Field of Classification Search
USPC ..... 74/89.22; 60/369; 175/52, 85, 195
See application file for complete search history.

(56) References Cited

U.S. PATENT DOCUMENTS 3,777,491 A * 12/1973 Bender ..... 60/372
3,782,117 A * 1/1974 James ..... 60/372
4,170,340 A * 10/1979 Mouton, Jr. ..... 254/386
4,187,680 A * 2/1980 Sanford ..... 60/369
4,341,270 A * 7/1982 Ferguson ..... 173/151
4,341,373 A * 7/1982 Mouton, Jr. ..... 254/386
4,418,609 A * 12/1983 Wickline et al. ..... 91/275
4,430,924 A * 2/1984 Dunn et al. ..... 91/277
4,483,662 A * 11/1984 Stanton ..... 417/53
4,552,339 A * 11/1985 Werners et al. ..... 254/277
4,696,221 A * 9/1987 Dollison ..... 91/51
4,755,080 A * 7/1988 Cortlever et al. ..... 405/50
6,032,929 A * 3/2000 Vatne ..... 254/385
6,095,501 A * 8/2000 Vatne ..... 254/385
8,082,734 B2 * 12/2011 St. Denis ..... 60/369
8,562,308 B1 * 10/2013 Krug et al. ..... 417/237
8,622,151 B2 * 1/2014 Ledbetter ..... 175/52

FOREIGN PATENT DOCUMENTS

CA 2514916 9/2011

* cited by examiner

*Primary Examiner* — David M Fenstermacher
(74) *Attorney, Agent, or Firm* — Ryan W. Dupuis; Kyle R. Satterthwaite; Ade & Company Inc.

(57) ABSTRACT

A drive assembly for connection to the polish rod of a reciprocating pump includes a support frame fixed in proximity to a wellhead. A linear actuator includes a lower portion fixed to the support frame and an upper portion supporting two pairs of direction altering cable guides thereon. Four lengths of cable each include a first portion substantially anchored to relative to the polish rod by a pump bracket, a second portion substantially anchored to the support frame by an anchor bracket, and an intermediate portion extending through a respective one of the direction altering cable guides on the upper portion of the linear actuator between the first portion and the second portion.

13 Claims, 6 Drawing Sheets

RECIPROCATING PUMP DRIVE ASSEMBLY

FIELD OF THE INVENTION

The present invention relates to a drive assembly for a pump of the type comprising a polish rod reciprocating relative to a wellhead, and more particularly the present invention relates to a drive assembly including a linear actuator a plurality of lengths of cable connected between the linear actuator and the polish rod by direction altering cable guides.

BACKGROUND

As disclosed in Canadian Patent Application 2,514,916 and corresponding issued U.S. Pat. No. 8,082,734 by St. Denis reciprocating pumps are extensively used on oil wells and they generally consist of a polish rod with cooperating valves that serve to pump liquids to surface as the polish rod is reciprocated in the well. According to St. Denis a drive assembly is provided for a reciprocating pump which includes a support structure and a linear actuator mounted on the support structure. The linear actuator has a stationary portion and a movable ram portion. At least one direction altering cable guide is mounted to the movable ram portion of the linear actuator. At least one cable is provided having a first end and a second end. The first end is anchored to one of the support structure or the stationary portion of the linear actuator. The second end is adapted for attachment to a polish rod of a reciprocating pump. As the movable ram portion moves, the cable and cable guide configuration provide a mechanical advantage which results in the polish rod reciprocally moving a multiple of the distance traveled by the movable ram portion of the linear actuator. The movable ram portion is driven by a rotating screw with a travelling nut; however, the mechanism requires use of additional shock absorbers to slow the movement of the travelling nut in the event of a power loss such that the resulting mechanism is complex and may require considerable maintenance to operate.

SUMMARY OF THE INVENTION

According to one aspect of the invention there is provided a drive assembly for a reciprocating pump including a polish rod arranged to be supported for reciprocating movement relative to a wellhead, the drive assembly comprising:

a support frame arranged to be supported in proximity to the wellhead;

a linear actuator including a lower portion arranged to be fixed to the support frame and an upper portion supported on the lower portion for linear reciprocating movement between a lowered position and a raised position;

a pump bracket arranged to be coupled to the polish rod of the reciprocating pump;

an anchor bracket arranged to be fixed to the support frame;

two pairs of direction altering cable guides supported on the upper portion of the linear actuator; and four lengths of cable in which each length of cable comprises:

a first portion substantially anchored to the pump bracket;

a second portion substantially anchored to the anchor bracket; and an intermediate portion extending through a respective one of the direction altering cable guides on the upper portion of the linear actuator between the first portion and the second portion.

The arrangement of two pairs of cable guides on the actuator together with four lengths of cable provides a considerable factor of safety in connecting the linear actuator to the polish rod to ensure minimal damage to the drive assembly would occur in the event of a cable failure as the linear actuator remains substantially balanced between the first portion anchored to the polish rod and the second portion anchored to the support frame. Preferably the lengths of cable are joined in series with one another so as to comprise a single, integral, and continuous strand of cable extending between two opposing ends. In this instance additional cable guides can be used at the connection to the support frame and the polish rod.

Preferably the continuous strand is coupled at each of the two opposing ends on the pump bracket. Preferably a junction between each adjacent pair of lengths of cable joined in series with one another is substantially anchored to the respective bracket by a direction altering cable guide fixed on said bracket.

Preferably the cable is supported on each cable guide so as to be relatively slidable in a longitudinal direction of the cable.

When two lengths of cable are joined integrally in series with one another at the pump bracket, the pump bracket preferably includes a direction altering cable guide fixed thereon upon which the integrally joined lengths of cable are substantially anchored.

Preferably the anchor bracket includes two direction altering cable guides fixed thereon in which each cable guide of the anchor bracket is associated with two lengths of cable which are integrally joined in series with one another at the respective cable guide upon which the integrally joined lengths of cable are substantially anchored.

When the direction altering cable guides of a first pair on the upper portion of the linear actuator each correspond to a first radius of curvature between the first portion and the second portion of the respective length of cable, preferably the direction altering cable guides of a second pair on the upper portion of the linear actuator correspond to a second radius of curvature between the first portion and the second portion of the respective length cable which is different from the first radius of curvature.

When the cable received in the cable guide at the pump bracket lies in a first plane, preferably the cable guides at the anchor bracket are oriented in a fixed angular relationship relative to one another such that the cable received in the cable guides at the anchor bracket each lie in a respective plane oriented transversely to said first plane.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
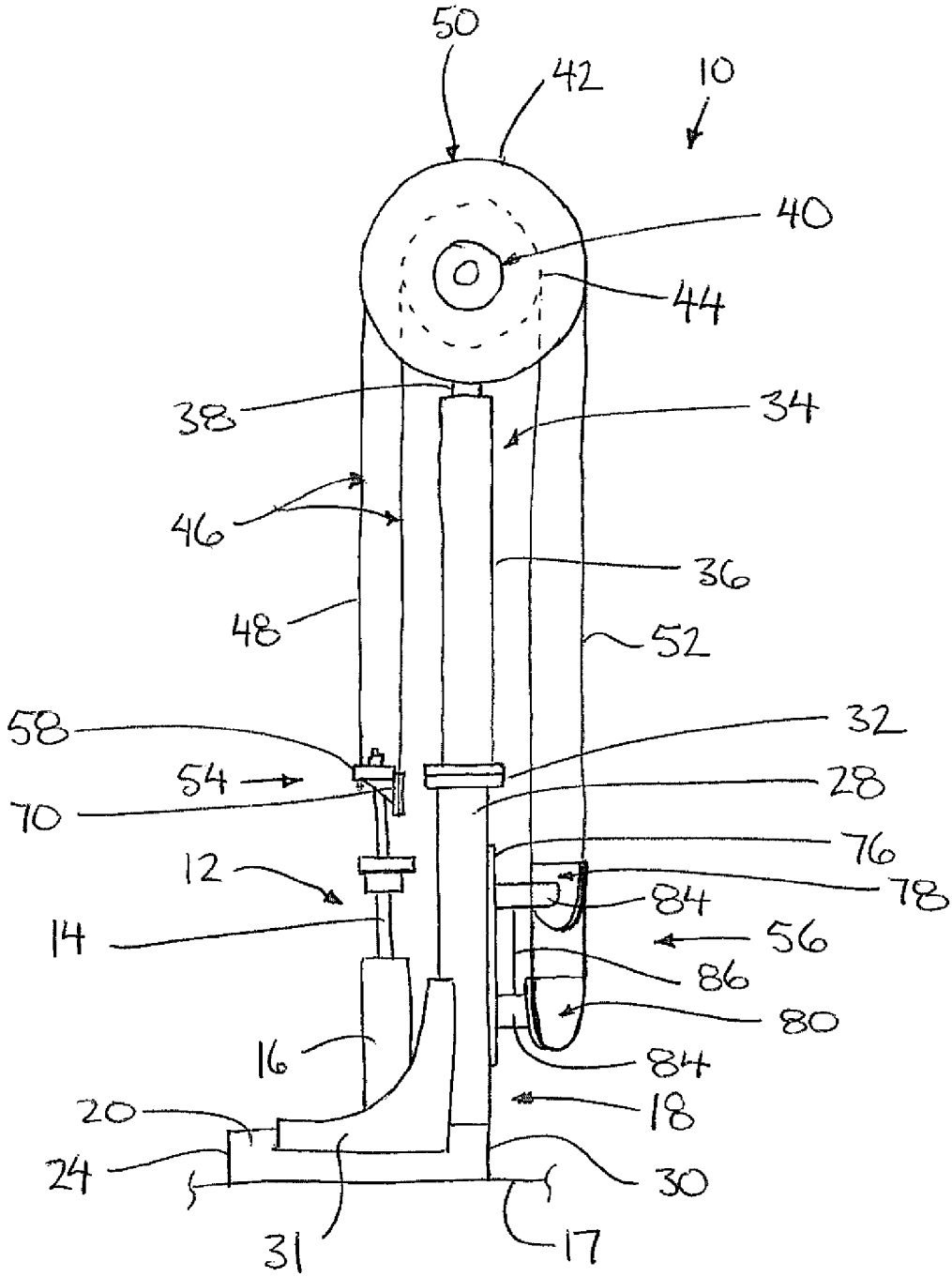
FIG. 1 is a side elevational view of the drive assembly.
Figure 2:
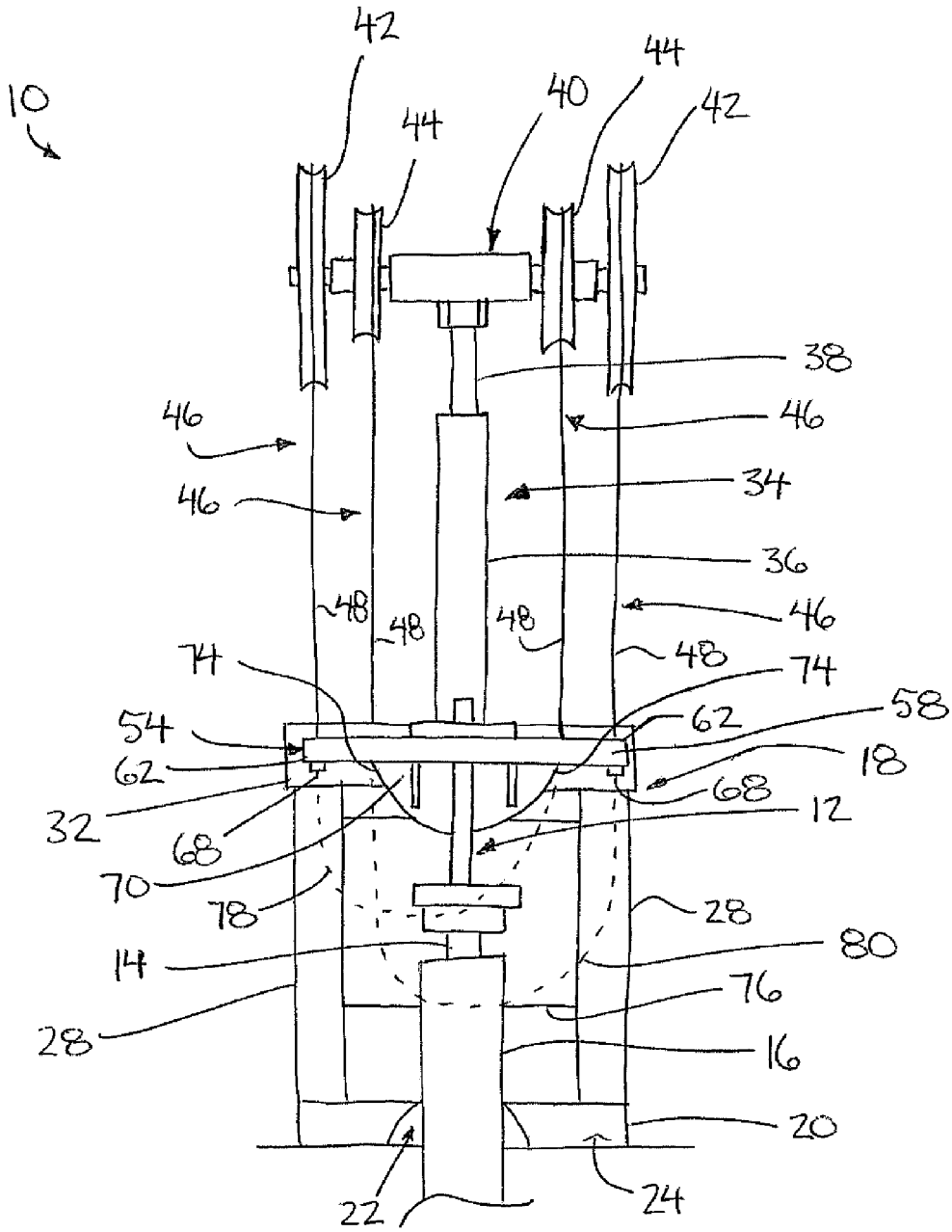
FIG. 2 is a front elevational view of the drive assembly.
Figure 3:
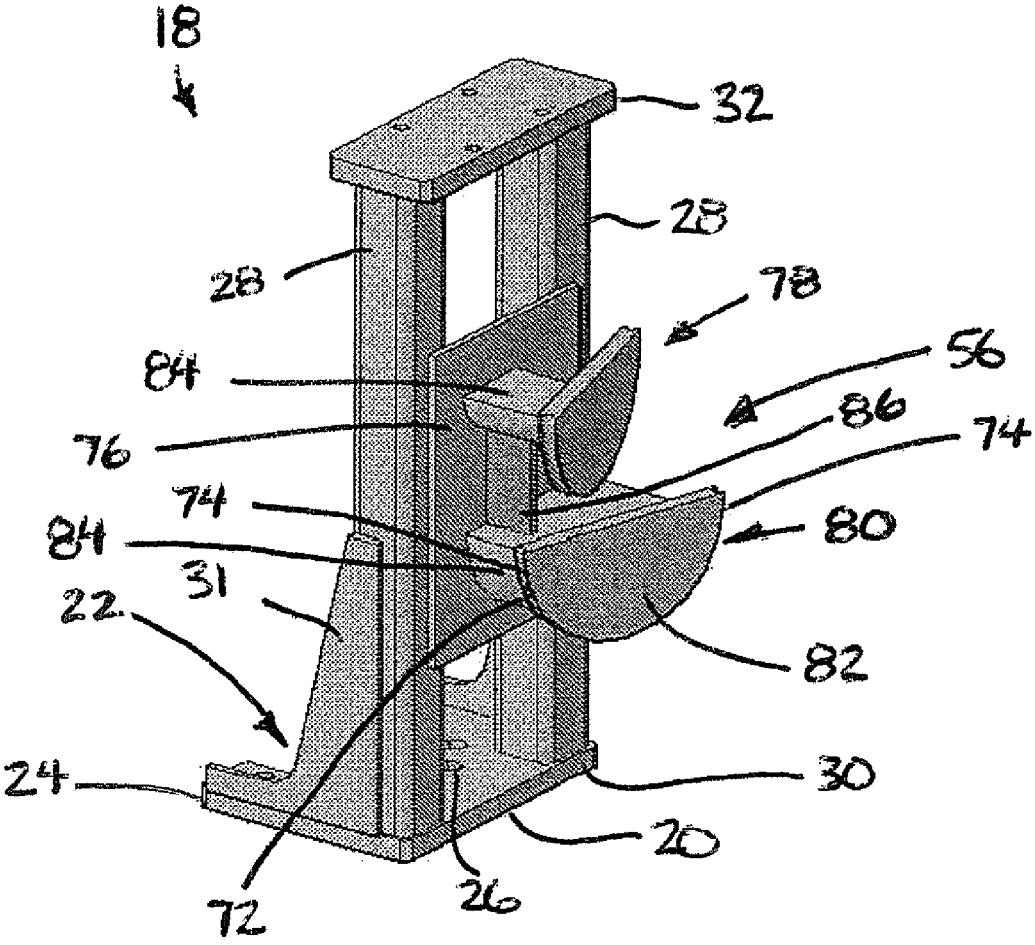
FIG. 3 is a perspective view of the support frame and the anchor (supported thereon).
Figure 4:
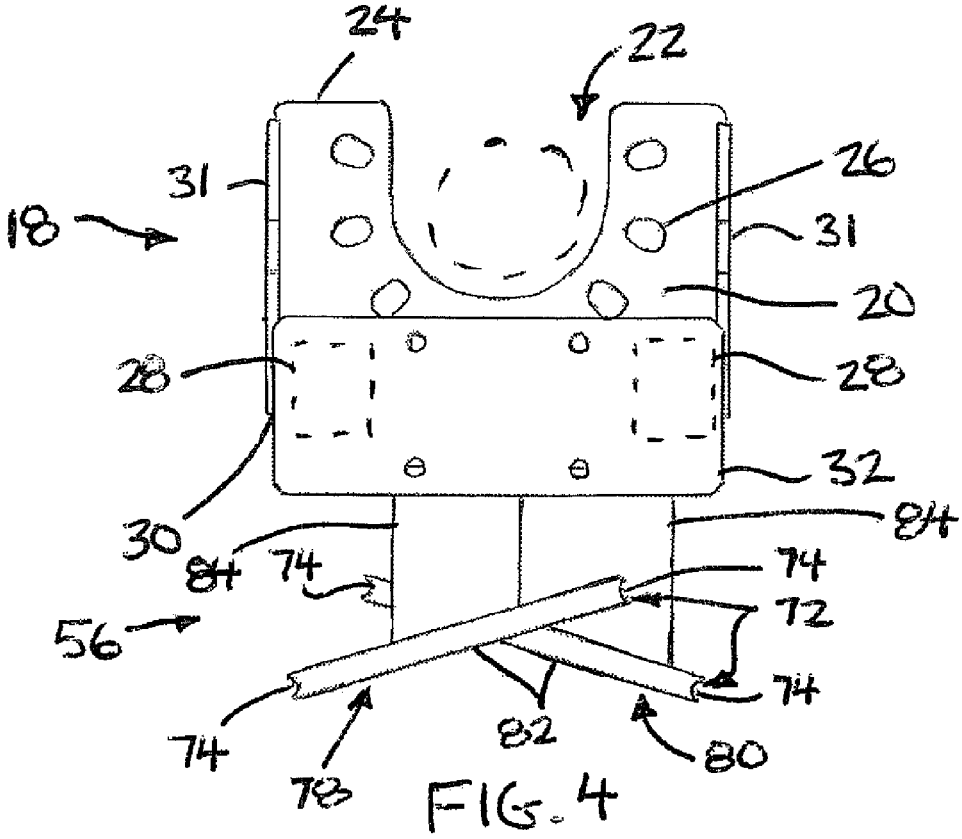
FIG. 4 is a top plan view of the support frame and anchor (supported thereon).
Figure 5:
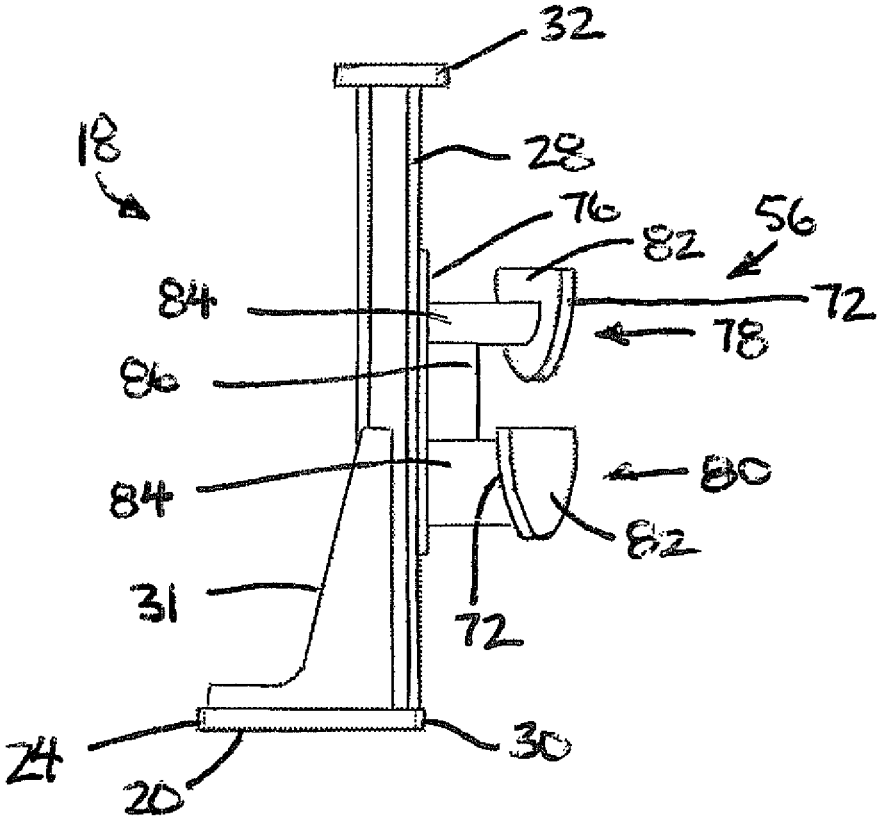
FIG. 5 is a side elevational view of the support frame and anchor (supported thereon).
Figure 6:
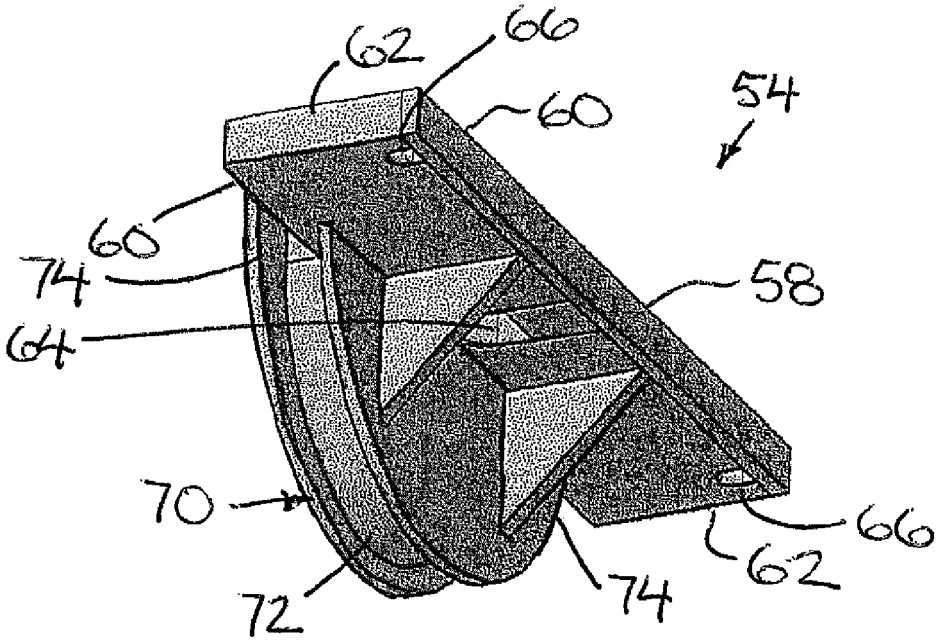
FIG. 6 is a perspective view of the pump bracket.
Figure 7:
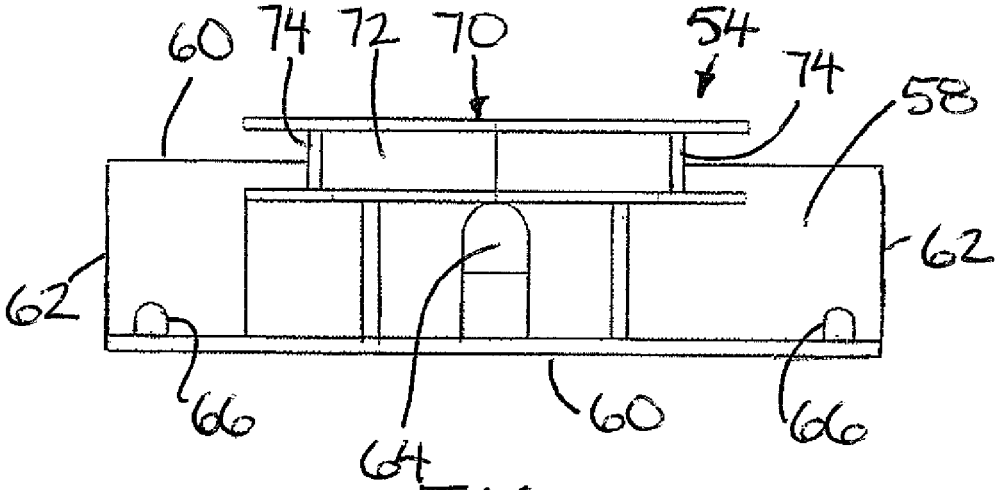
FIG. 7 is a bottom plan view of the pump bracket.

Referring to the accompanying figures, there is illustrated a reciprocating pump drive assembly generally indicated by reference numeral 10. The assembly 10 is particularly suited for use with a reciprocating pump 12 of the type commonly used in the oil industry. Typically, the pump comprises a polish rod 14 slidably received through the seals of a stuffing box 16 at the well head of a well such that the rod is vertically slidable in a longitudinal direction relative to the well bore.

The drive assembly 10 includes a support frame 18 arranged to be fixed in relation to the well head. The frame includes a base plate 20 supported in a horizontal orientation. The base plate is a flat plate which is generally U-shaped about an interior opening 22 through which the polish rod is arranged to be received. The opening 22 is open to a first side 24 of the base plate to define the U-shape of the base plate about the opening. Fastener apertures 26 are located at circumferentially spaced positions about a perimeter of the interior opening in a generally U-shaped pattern to accommodate fasteners for fastening to the well head about the polish rod through an arc of greater than 180 degrees about the periphery of the well head.

The frame 18 further comprises two uprights 28 comprising posts of rectangular cross section of tubular steel material which are parallel and spaced apart from one another along one edge of the base plate at the second side 30 opposite from the first side 24. The two uprights lie in a generally common center plane of the drive assembly as described in further detail below.

The frame further includes two gussets 30 joined between the uprights 28 respectively and the base plate such that each gusset spans from the upright to the base plate towards the opposing first side 24 thereof. The gussets are supported along opposing sides of the base plate for locating the interior opening and the polish rod received therethrough centrally therebetween.

A mounting plate 32 is joined between the two uprights at the top end thereof to span horizontally and locate fastener apertures therein to define a mounting surface for the bottom end of a linear actuator 34 mounted thereon. The linear actuator 34 is a hydraulic piston cylinder configuration mounted for vertical extension and retraction above the uprights 28 at a laterally central location between the two uprights within the common central plane thereof.

The actuator includes a lower portion 36 defining a hollow chamber functioning as the cylinder portion of the actuator which remains stationery and fixed relative to the support frame 18 and the wellhead. An upper portion 38 is supported on the lower portion in the form of a ram which is vertically slidable and moveable relative to the lower portion. The upper portion includes a piston at the bottom end thereof which is received within the cylinder portion of the lower portion 36 so as to vary the chamber size between the piston and the bottom end of the lower portion as the upper portion is linearly displaced relative to the lower portion. Suitable hydraulic control lines communicate with the interior of the hollow chamber of the lower portion adjacent the bottom side thereof such that the upper portion can be displaced between a lowered position and an extended raised position by controlling the amount of hydraulic fluid introduced into the hollow chamber in a conventional manner.

A mounting frame 40 is supported at the top end of the linear actuator for movement with the upper portion relative to the lower portion. The mounting frame generally comprises a shaft mounted horizontally within the central plane of the uprights 28 to span laterally outward in two opposing directions towards opposing ends of the shaft, locating the linear actuator centrally therebetween.

The mounting frame supports a pair of first cable guides 42 thereon at the respective opposing ends of the shaft such that the first cable guides 42 are laterally spaced apart in the axial direction of the shaft at equal distances at opposing sides from the linear actuator centered therebetween. Each first cable guide 42 comprises a pulley wheel mounted coaxially with the shaft such that an outer periphery of the pulley wheel includes a circumferential groove receiving a cable therethrough to change the direction of the cable in a generally U-shaped pattern when extending over top of the pulley wheel between two opposing sides of the central plane of the uprights as described in further detail below. The radius of the pulley wheels defines a first radius of curvature of the change in cable orientation as it passes through the cable guide.

The mounting frame further supports a pair of second cable guides 44 also coaxially on the shaft so as to be coaxial with the first cable guides but at a narrower lateral spacing in the axial direction of the shaft. The second guides are similarly laterally spaced in equal distances on opposite sides of the linear actuator received centrally therebetween such that the second cable guides 44 are located at intermediate positions between the two first cable guides. The second cable guides similarly comprise pulley wheels with a circumferential groove for receiving a cable therein to change the direction of the cable passing therethrough in a generally U-shaped pattern overtop of the cable guide between opposing sides of the central plane of the uprights.

The cable in this instance comprises a single, continuous and integral strand of steel cable which is comprised of four cable lengths 46 connected in series with one another and each substantially anchored between the support rod and the polish rod at opposing sides of the central plane by extending back and forth overtop of the cable guides on the mounting frame 40. The multiple lengths of cable anchored between the support frame on one side of the common plane and the polish rod on the other side of the common central plane provide a mechanical advantage for reciprocating the polish rod in response to reciprocation of the linear actuator while also multiplying the stroke length of the actuator.

In the illustrated drive assembly, four lengths of cable 46 are provided integrally in series with one another such that each length of cable includes a first portion 48, an intermediate portion 50 and a second portion 52. In each instance, the first portion 48 is substantially anchored at a pump bracket 54 which connects the cables to the top end of the polish rod and extends substantially vertically upward towards the cable guides on the top of the mounting frame of the linear actuator spaced outwardly from a first side of the central plane.

Each intermediate portion 50 alters in direction as it extends over the respective cable guide among the first and second cable guides 42 and 44 so as to be generally U-shaped as it crosses over from the first portion 48 spaced outward from a first side of a central plane to the respective second portion 52. The second portion 52 is spaced outwardly from the opposing second side of the central plane by an equal amount as the respective first portion due to the cable guides being coaxial with the shaft located in alignment with the common central plane of the uprights.

Each second portion 52 extends substantially vertically downward from the intermediate portion before being anchored at the bottom end to an anchor bracket 56 supported in fixed relation on the support frame 10 such that the second portion spans substantially vertically.

The pump bracket 54 includes a mounting plate 58 which is generally horizontal in use and is elongate in a lateral direction such that two opposing sides 60 span in the lateral direction between two opposing ends 62. A central opening 64 is located through the mounting plate at a central location between the two sides 60 and the two ends 62 for receiving suitable fastening members for securement to the top end of the polish rod such that the mounting plate is fixed in relation to the polish rod in use.

The mounting plate 58 further includes two mounting apertures 66 spaced apart laterally at opposing ends 62 to locate the central opening centrally therebetween in the lateral direction, however, the mounting apertures are offset along one of the side edges 60 in the other direction. The two mounting apertures are arranged for receiving the two opposing ends of the continuous strand of cable or suitable fasteners for fastening the two cable ends 68 thereto. The two mounting apertures are spaced apart in the lateral direction by a distance corresponding to the lateral distance between the two first cable guides at opposing ends of the shaft such that respective second portions of the cable lengths extending from the first cable guides are aligned with the two mounting apertures 66 in the assembled configuration when the respective second portions of the lengths of cable extend substantially vertically therebetween.

The pump bracket further includes a cable guide 70 at the second side of the mounting plate opposite from the first side locating the two mounting apertures therein such that the central opening is substantially centered between the mounting apertures at the first side and the cable guide at the second side. The cable guide 70 on the pump bracket defines a generally U-shaped channel 72 for receiving a respective portion of cable therein to alter the direction of the cable through an arc of approximately 180 degrees.

The channel 72 includes two opposing ends 74 and a curved portion therebetween which curves downwardly and inwardly from both ends 74 to a central apex defining a lowest portion of the channel. The two opposing ends 74 are spaced apart by a distance corresponding to the lateral or axial space between the two second cable guides on the actuator for alignment with the respective second portions of the respective lengths of cable extending downwardly therefrom. The cable guide 70 on the pump bracket receives a junction between two lengths 46 of cable where two of the lengths connected in series are integrally joined with one another and change of direction through the cable guide. The junction between adjacent cable lengths received within the cable guide on the pump bracket corresponds to the center of the continuous strand of cable.

The two portions of cable substantially anchored to the cable guide at the second side of the mounting plate 58 are thus balanced in one direction with the two additional portions of cable anchored at spaced positions at the opposing first side of the mounting plate 58. Furthermore the cables at each respective side of the mounting plate are laterally balanced with the polish rod connection being laterally centered therebetween. The cables thus provide a substantially even and balance lifting force to the polish rod as the linear actuator is extended and substantially equal tension is applied to the cables.

The anchor bracket 56 is mounted on the uprights 28 of the support frame in fixed relation therewith at the first side of the central plane opposite from the pump bracket. The anchor bracket generally includes a base plate 76 which is mounted vertically on the uprights parallel and adjacent to the central plane thereof. The base plate 76 supports an upper cable guide 78 and a lower cable guide 80 thereon in which both cable guides are configured generally similarly to the cable guide 70 of the pump bracket so as to comprise a generally U-shaped channel 72 which is curved downwardly and inwardly from both ends 74 to a central apex defining the lowest portion of channel.

Although the plane of the cable received through the cable guide 70 of the pump bracket is parallel to the central plane of the uprights, the plane of the cable received within each of the upper and lower cable guides 78 and 80 are oriented in upright planes at respective fixed angular orientations transversely to the first plane of the pump bracket cable guide 70 and the central plane of the uprights.

More particularly, each of the upper cable guide 78 and the lower cable guide 80 is generally semi-circular between the two opposing ends 74 thereof to define a respective radius of curvature for altering the direction of the cable received therethrough. The radius of curvature of the upper and lower guides is substantially equal to one another as each spans a distance between the two opposing ends 74 thereof which corresponds approximately to the distance from one of the first cable guides at one side of the linear actuator to a corresponding second cable guide at the opposing side of the linear actuator.

Each of the channels 72 of the respective cable guides are supported in this arrangement such that one end is in vertical alignment directly below the outermost peripheral edge of the respective first cable guide of the linear actuator while the other end is aligned vertically below the corresponding outermost peripheral edge of the respective second cable guide so that the respective first portions of cable spanning therebetween are substantially vertical in orientation. As with the other cable guides, each of the upper cable guide 78 and lower cable guide 80 receives a portion of the cable therethrough which corresponds to an integral junction between two adjacent lengths of the cable connected in series with one another to form the continuous cable strand.

The channel 72 of each of the upper cable guide and the lower cable guide is defined as a circumferential groove about the periphery of an upright semi-circular plate 82. Each of the plates 82 is supported by a support member 84 fixed at an inner end to the base plate 76 to extend outward from the central plane towards an outer end fixing the respective plate 82 thereon such that the upper guide is located spaced above the lower guide. An additional support plate 86 spans vertically between the support members of the upper and lower cable guides and is joined at an inner edge to the base plate to function as a gusset to provide additional support to each plate 82.

By providing the configuration of anchor bracket and pump bracket as disclosed herein, a single strand of cable can be wound about the cable guides to define four individual lengths 46 of cable, each substantially anchored at a first portion to the anchor bracket, extending over a respective cable guide on the linear actuator at an intermediate portion, and being anchored to the pump bracket at an opposing end. The cable guides may receive the cables therethrough such that the cable is relatively slidable in relation to the cable guides and the channels or grooves receiving the cable therethrough such that as the linear actuator is extended and retracted, minor imbalances resulting from the different radius of curvatures of the different cable guides can be accommodated for to maintain an even tension on the cables. At some cable guides however, additional fasteners or clamping assemblies may be used to clamp respective sections of the cable within the cable guides so as to be substantially fixed relative to one another.

The arrangement of the pump bracket and the anchor bracket of the present invention is most distinguished from the prior art and most advantageous in that it permits four lengths of cable to be connected in a manner which maintains balance between the forces of tension pulling upwardly on the polish rod with each reciprocation to minimize any unnecessary wear on the polish rod which can otherwise occur due to imbalanced lifting forces. The four lengths of cable also provide a considerable factor of safety for transferring lifting force from the linear actuator to a corresponding lifting force on the polish rod during up and down reciprocation of the reciprocating pump.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A drive assembly for a reciprocating pump including a polish rod arranged to be supported for reciprocating movement relative to a wellhead, the drive assembly comprising:

a support frame arranged to be supported in proximity to the wellhead;

a linear actuator including a lower portion arranged to be fixed to the support frame and an upper portion supported on the lower portion for linear reciprocating movement between a lowered position and a raised position;

a pump bracket arranged to be coupled to the polish rod of the reciprocating pump;

an anchor bracket arranged to be fixed to the support frame;

two pairs of direction altering cable guides supported on the upper portion of the linear actuator; and four lengths of cable in which each length of cable comprises:

a first portion substantially anchored to the pump bracket;

a second portion substantially anchored to the anchor bracket; and an intermediate portion extending through a respective one of the direction altering cable guides on the upper portion of the linear actuator between the first portion and the second portion.

2. The drive assembly according to claim 1 wherein the lengths of cable are joined in series with one another so as to comprise a single, integral, and continuous strand of cable extending between two opposing ends.

3. The drive assembly according to claim 2 wherein the continuous strand is coupled at each of the two opposing ends on the pump bracket.

4. The drive assembly according to claim 2 wherein a junction between each adjacent pair of lengths of cable joined in series with one another is substantially anchored to the respective bracket by a direction altering cable guide fixed on said bracket.

5. The drive assembly according to claim 4 wherein the cable is supported on each cable guide so as to be relatively slidable in a longitudinal direction of the cable.

6. The drive assembly according to claim 1 wherein the two lengths of cable are joined integrally in series with one another at the pump bracket and wherein the pump bracket includes a direction altering cable guide fixed thereon upon which the integrally joined lengths of cable are substantially anchored.

7. The drive assembly according to claim 1 wherein at least two lengths of cable are joined integrally in series with one another at the anchor bracket and wherein the anchor bracket includes a direction altering cable guide fixed thereon in association with the integrally joined lengths of cable upon which the integrally joined lengths of cable are substantially anchored.

8. The drive assembly according to claim 1 wherein the anchor bracket includes two direction altering cable guides fixed thereon in which each cable guide of the anchor bracket is associated with two lengths of cable which are integrally joined in series with one another at the respective cable guide upon which the integrally joined lengths of cable are substantially anchored.

9. The drive assembly according to claim 1 wherein the direction altering cable guides of a first pair on the upper portion of the linear actuator each correspond to a first radius of curvature between the first portion and the second portion of the respective length of cable and the direction altering cable guides of a second pair on the upper portion of the linear actuator correspond to a second radius of curvature between the first portion and the second portion of the respective length cable in which the first and second radii of curvature are different from one another.

10. The drive assembly according to claim 9 wherein the lengths of cable associated with the first pair of cable guides are joined integrally in series with one another at the pump bracket and wherein the pump bracket includes a direction altering cable guide fixed thereon upon which the integrally joined lengths of cable are substantially anchored.

11. The drive assembly according to claim 9 wherein each length of cable associated with the first pair of cable guides is joined at a junction integrally in series with a respective one of the lengths of cable associated with the second pair of cable guides at the anchor bracket at the anchor bracket and wherein the anchor bracket includes two direction altering cable guides fixed thereon in which each cable guide of the anchor bracket substantially anchors one of the junctions between lengths of cable thereon.

12. The drive assembly according to claim 11 wherein the lengths of cable associated with the first pair of cable guides are joined integrally in series with one another at the pump bracket and wherein the pump bracket includes a direction altering cable guide fixed thereon upon which the integrally joined lengths of cable are substantially anchored.

13. The drive assembly according to claim 9 wherein the cable received in the cable guide at the pump bracket lies in a first plane and wherein the cable guides at the anchor bracket are oriented in a fixed angular relationship relative to one another such that the cable received in the cable guides at the anchor bracket each lie in a respective plane oriented transversely to the first plane.

* * * * *